US007101263B2

(12) United States Patent
Schwartz et al.

(10) Patent No.: US 7,101,263 B2
(45) Date of Patent: Sep. 5, 2006

(54) FLANK SUPERABRASIVE MACHINING

(75) Inventors: Brian J. Schwartz, West Hartford, CT (US); Bernard D. Vaillette, Tolland, CT (US); Chung Y. Wu, Middletown, CT (US); Gennaro J. Colacino, Southampton, MA (US); Allan B. Packman, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 281 days.

(21) Appl. No.: 10/289,493

(22) Filed: Nov. 6, 2002

(65) Prior Publication Data

US 2004/0087256 A1 May 6, 2004

(51) Int. Cl.
*B24B 1/00* (2006.01)

(52) U.S. Cl. ..... 451/56; 451/319; 451/324

(58) Field of Classification Search ..... 451/56, 451/319, 324, 540, 541
See application file for complete search history.

(56) References Cited

U.S. PATENT DOCUMENTS 2,427,849 A * 9/1947 Garwood ..... 51/293
3,774,349 A * 11/1973 Uhtenwoldt et al. ..... 451/25
4,512,115 A 4/1985 Miller
4,720,942 A 1/1988 Miller
5,203,122 A 4/1993 Campbell
5,339,506 A * 8/1994 Nusz ..... 29/252
5,364,422 A 11/1994 Kitajima et al.
5,398,455 A * 3/1995 Slavin et al. ..... 451/540
5,707,278 A * 1/1998 Korn ..... 451/463
6,279,211 B1 * 8/2001 Dischler ..... 26/18.6

FOREIGN PATENT DOCUMENTS

FR 1 021 949 2/1953
GB 2 312 386 10/1997

* cited by examiner

*Primary Examiner*—Lee D. Wilson
*Assistant Examiner*—Anthony Ojini
(74) *Attorney, Agent, or Firm*—Bachman & LaPointe

(57) ABSTRACT

The present invention relates to a quill to be used to superabrasively machine complex shapes, such as airfoil shapes, into a substrate. The quill has a shaft portion, an enlarged head portion adjacent the shaft portion, and a tapered grinding portion adjacent the enlarged head portion. The tapered grinding portion has a layer of grit material selected from the group consisting of diamonds and cubic boron nitride thereon. In a preferred embodiment, the quill is a vitrified or plated cubic boron nitride quill on the grinding portion. A method of using the tool is also disclosed.

10 Claims, 1 Drawing Sheet

FLANK SUPERABRASIVE MACHINING

BACKGROUND OF THE INVENTION

The present invention relates to a tool and a method for machining complex airfoil shapes in materials such as nickel or titanium alloys.

In the past, airfoil shapes have been machined using a variety of different techniques. These techniques included flank milling, electro-chemical machining (ECM), and conventional point milling. These techniques however are slow and the tools used to perform them do not have a particularly long life especially, in hardened alloyed materials such as nickel alloys. The cutting forces produced during the milling operation result in high loads on the workpiece which can result in airfoil deflection and chatter that results in poor surface finish. It is also difficult using these techniques to produce surface finishes that meet part requirements without additional processing such as hand polishing or media finishings.

Thus, there is a need for an improved tool and an improved method for machining complex airfoil shapes in less time at lower loads.

SUMMARY OF THE INVENTION

Accordingly, it is an object of the present invention to provide an improved tool for machining complex shapes in less time at lower load and with improved surface finishes.

It is a further object of the present invention to provide a tool as above which lasts longer than convention tools.

It is yet a further object of the present invention to provide an improved method for machining complex shapes.

The foregoing objects are attained by the tool and the method of the present invention.

In accordance with the present invention, a tool which may be used in superabrasive machining is disclosed. The tool broadly comprises a shaft portion, an enlarged head portion adjacent the shaft portion, and a tapered grinding portion adjacent to the enlarged head portion. The tapered grinding portion has a layer of grit material selected from the group consisting of diamonds and/or cubic boron nitride. The grit material may be electroplated to the grinding portion. For finishing cuts, the tool is a vitrified quill.

In accordance with the present invention, a method for superabrasive machining an airfoil shape in a substrate is provided. The method broadly comprises the steps of providing a tool having a shaft portion, an enlarged head portion, and a tapered grinding portion having a layer of grit material thereon, inserting the shaft portion into a grinding spindle, rotating the tool at a spindle speed in the range of 40,000 RPM to 90,000 RPM, and placing the tool into contact with a substrate material.

Other details of the tool and the method of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
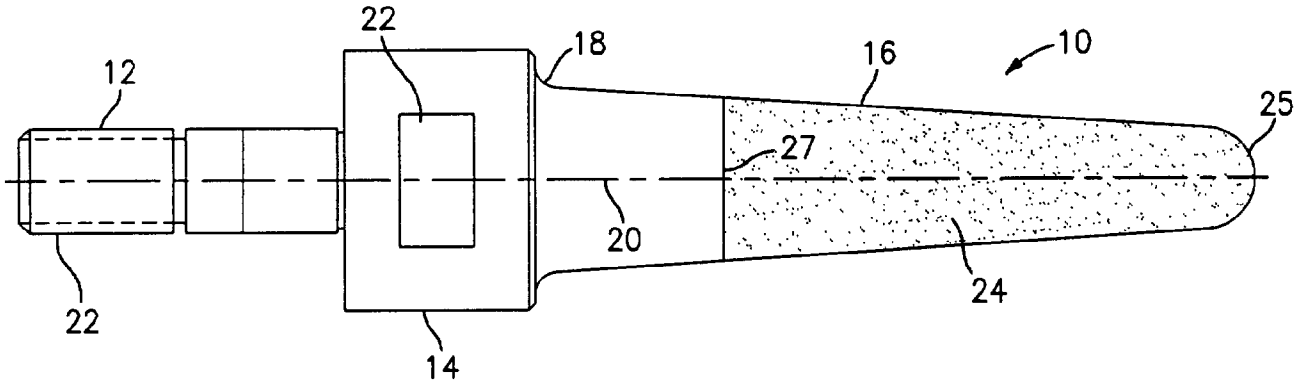
FIG. 1 is a schematic representation of a tool in accordance with the present invention.
Figure 2:
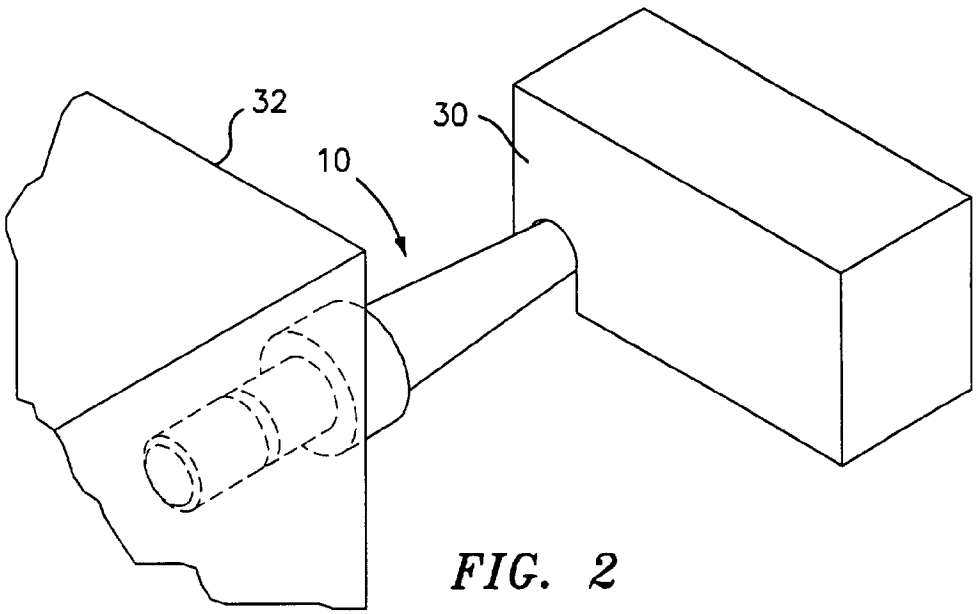
FIG. 2 illustrates the tool of FIG. 1 in a machine tool and forming a slot in a substrate material.

Referring now to the drawings, FIG. 1 illustrates a flank superabrasive machining tool or quill 10 for machining complex airfoil shapes into a substrate material selected from the group of nickel alloys, titanium alloys, and stainless steel. The tool 10 has a shaft portion 12, an enlarged head portion 14, and a tapered grinding portion 16. The tapered grinding portion 16 is joined to the head portion 14 by a fillet portion 18.

The shaft portion 12 of the tool 10 is intended to fit into a grinding spindle of a milling machine. The tool 10 has a longitudinal axis 20 about which it is rotated. The shaft portion 12 and the head portion 14 are each provided with a plurality of flat portions 22 for accommodating a wrench.

The tool 10 may be formed from any suitable tool material known in the art such as a steel material.

The grinding portion 16 has thereon a layer of grit material 24 selected from the group consisting of diamonds and cubic boron nitride. The grit material 24 may extend over the entire length of the grinding portion 16 or just a portion of the grinding portion. In a preferred embodiment of the tool, the grit material 24 extends from the tip 25 of the tapered grinding portion 16 to a point 27 which is about 70 to 75% of the length of the tapered grinding portion 16.

The grit material 24 preferably has a grit size in the range of 40 to 400, preferably 45 to 325. The grit material 24 may be electroplated or brazed onto the tapered grinding portion 16. For example, the grit material could be cubic boron nitride plated onto the tapered grinding portion 16. For finishing cuts, the tool is a vitrified cubic boron nitride or diamond tool having a layer of vitrified grit material on the grinding portion 16. It is preferred to use a vitrified grit applied to portion 16 for finishing cuts because the quill 10 can be dressed to produce less run-out and therefore result in better surface finishes. Also, when the grit wears, it can be redressed or sharpened to produce a better surface finish. A vitrified grit material has a glass type ceramic bonding material which holds the abrasive grits together and then bonded to the underlying tool substrate.

To form a complex airfoil shape in a substrate material 30, the tool 10 is inserted into a grinding spindle in a multi-axis machine tool 32. The tool 10 is then rotated about its longitudinal axis 20 by the machine 32 at a spindle speed in the range of 40,000 RPM to 90,000 RPM. The tool is cooled and lubricated by a nozzle (not shown) which distributes oil or water lubricant on the tool 10 and the workpiece or substrate material 30. The tool 10 is then moved into contact with the substrate material 30 and maneuvered to form a desired complex shapes, e.g. an airfoil shape. Movement of the tool 10 and the machine 32 is controlled by software which generates a tool path in multiple directions. The particular software which is used varies from part to part being produced. The shapes which are formed can follow an arbitrary airfoil shape for components such as integrally bladed rotors or blisk.

The method of the present invention is advantageous because it is capable of producing very fine surface finishes, less than 10 μin, with machining times much less than conventional flank milling, ECM or conventional point milling techniques. The method of the present invention uses lower loads and therefore has less chatter and deflection. The superabrasive machining quill tool of the present invention lasts longer than the tools used in conventional methods used to produce integrally bladed rotors.

It is apparent that there has been provided in accordance with the present invention a flank superabrasive machining tool which fully satisfies the objects, means, and advantages set forth hereinbefore. While the present invention is described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A tool for use in superabrasive machining comprising:

a shaft portion;

an enlarged head portion adjacent the shaft portion;

a tapered grinding portion adjacent the enlarged head portion; and said tapered grinding portion having a layer of grit material selected from the group consisting of diamonds and cubic boron nitride.

2. A tool according to claim 1, wherein said grit material is electroplated onto said tapered portion.

3. A tool according to claim 1, wherein said grit material is brazed onto said tapered grinding portion.

4. A tool according to claim 1, wherein said grit material is cubic boron nitride plated onto said tapered grinding portion.

5. A tool according to claim 1, wherein said grit material is a vitrified cubic boron nitride material.

6. A tool according to claim 1, wherein said enlarged head portion is joined to said tapered grinding portion by a fillet portion.

7. A tool according to claim 1, wherein each of said shaft portion and said enlarged head portion have a plurality of flats to accommodate a wrench.

8. A tool according to claim 1, wherein said grit material has a grit size in the range of 40 to 400.

9. A tool according to claim 1, wherein said grit material has a grit size in the range of 45 to 325.

10. A tool for use in superabrasive machining comprising:

means for fitting said tool into a grinding spindle of a milling machine;

said fitting means comprising a shaft portion;

an enlarged head portion adjacent the shaft portion;

a tapered grinding portion adjacent the enlarged head portion;

said tapered grinding portion having a layer of grit material adhered to said tapered portion; and said layer of grit material comprising a grit material selected from the group consisting of diamonds and cubic boron nitride.

* * * * *